United States Patent [19]

Healy

[11] 4,057,086

[45] Nov. 8, 1977

[54] VAPOR CONTROL

[76] Inventor: James W. Healy, 54 Plymouth Road, Wakefield, Mass. 01880

[21] Appl. No.: 553,529

[22] Filed: Feb. 27, 1975

[51] Int. Cl.[2] ..... B65B 57/14

[52] U.S. Cl. ..... 141/206; 141/44

[58] Field of Search ..... 141/39–44, 141/52, 59, 97, 290, 310, 387, 382–384, 388, 390, 392, 198–229, 287, 46; 285/263, 272; 403/50, 51; 417/79, 182.5

[56] References Cited

U.S. PATENT DOCUMENTS

| | | | |
|---|---|---|---|
| 3,810,714 | 5/1974 | Turner | 417/182.5 |
| 3,814,148 | 6/1974 | Wostl | 141/392 |
| 3,840,055 | 10/1974 | Wostl et al. | 141/392 |
| 3,866,636 | 2/1975 | Lasater | 141/392 |
| 3,915,206 | 10/1975 | Fowler et al. | 417/79 |

*Primary Examiner*—Houston S. Bell, Jr.

*Attorney, Agent, or Firm*—W. R. Hulbert

[57] ABSTRACT

Fuel vapors displaced from a vehicle's fuel tank during refueling are recovered by a system employing a liquid jet pump to produce a suction. A minor portion of a conventional fuel pump's output is diverted from the usual metering-and-dispensing conduits, passed through the jet pump, and then recycled to the fuel reservoir which supplies the fuel pump. The familiar fuel dispensing nozzle is provided with passages for conveying vapors away from the vehicle fuel tank. A vapor conduit links those passages with the jet pump thereby aspirating the displaced vapors to the jet pump and, ultimately, the fuel reservoir. Valving arrangements in the nozzle's vapor passages are suited for use with various vapor recovery systems, as is a mechanism which automatically interrupts the dispensing of fuel when there arises a danger of either fuel or vapor escaping from the vehicle's tank.

3 Claims, 6 Drawing Figures

VAPOR CONTROL

BACKGROUND OF THE INVENTION

This invention relates to a system for preventing the escape of hydrocarbon vapors to the atmosphere during the refueling of a vehicle from a service station's fuel dispensing apparatus.

Previous vapor recovery systems have included passages in the fuel dispensing nozzle for collecting vapors from the vehicle fuel tank, as well as a vapor return line for delivery of the collected vapors to the underground fuel reservoir. Each of these prior systems, however, has suffered from one or more of various drawbacks.

Some systems have relied solely upon vapor pressure within the fuel tank to push vapor through the vapor return line. To minimize resistance to vapor flow, these systems have required a large and cumbersome vapor return line. Additionally, when that return line became blocked by liquid (e.g., from fuel splashback or condensation), the vapor pressure developed in the vehicle fuel tank was usually insufficient to overcome the blockage. The result was vapor leakage to the atmosphere at the nozzle-fuel tank interface.

Other systems have employed a vacuum-assist for drawing vapor through a vapor return line. To avoid the expense of a separate vacuum pump at each service station pump housing, such systems have typically resorted to a powerful, continuously-operating blow-type vacuum pump and a complicated arrangement of electrically actuated valves for connecting the various vapor return lines to the vacuum pump when the various pumps were actuated for fuel dispensing. Acceptance of these systems has been minimal because of the expense and difficulty of both installation and maintenance. Additionally, such systems typically draw such a large volume of ambient air, relative to the volume of fuel vapor, that there is danger of an explosive mixture being formed.

Finally, it has been suggested that each fuel dispensing unit include a vacuum pump driven by the unit's conventional fuel meter and connected to a vapor return line. The well known fragility of the meter, however, renders suspect the practicality of this suggestion.

SUMMARY OF THE INVENTION

In view of the foregoing, it is a principal object of the present invention to provide a vapor recovery system which is simple, foolproof, and inexpensive to install and maintain.

Vapor control systems constructed according to the present invention are compatible with conventional fuel dispensing arrangements which include a fuel reservoir, a pump, and a dispensing nozzle having a spout insertable into the fill pipe of a vehicle's fuel tank. The vapor control system employs a liquid jet gas pump connected to receive a portion of the fuel pump output and to discharge fuel to the reservoir. A vapor conduit has one end in the dispensing nozzle communicating with the vehicle fuel tank fill pipe when the nozzle's spout is inserted therein, and the other end communicating with the jet pump suction inlet, thereby aspirating vapor from the vehicle tank, through the vapor conduit and jet pump, and into the fuel reservoir means associated with the nozzle are provided for regulating the pressure in the space between the nozzle and the fill pipe when the nozzle is inserted therein. In preferred embodiments in which a conventional flexible hose (e.g., 1 inch diameter) delivers fuel from the meter to the nozzle, the vapor conduit comprises a smaller diameter flexible hose (e.g., 5/16 inch diameter) disposed within the fuel hose; the jet pump produces a vacuum of about 12 inches to 16 inches of water and generates a vapor velocity within the vapor conduit (e.g., 2800 feet per minute) sufficient to break up and remove liquid blocking the vapor conduit; and the jet pump includes a pressure-compensating feedback line from the jet pump's output, through a biased-closed valve, to the jet pump input.

In another aspect the invention features improvements in a fuel dispensing nozzle as discussed above which further facilitate vapor control. According to this aspect of the invention, the improvements are provided in a fuel dispensing nozzle of conventional design having a liquid fuel channel leading to a spout insertable into a vehicle fuel tank, a manually operable valve in the fuel channel, and a vapor conduit for transporting fuel vapor displaced from the vehicle fuel tank. In such a nozzle the present improvements comprise a second valve disposed in the vapor conduit for controlling flow in that conduit. In alternative preferred embodiments, the second valve either is linked to the fuel valve for simultaneous operation therewith or operates only in response to a predetermined vapor pressure in the vehicle fuel tank. In the latter embodiment, the second valve preferably comprises a flexible diaphragm which is biased to either an open or a closed configuration.

In another aspect of the invention, such a fuel dispensing nozzle, with or without a vapor conduit, is provided with improved check means for releasably holding the fuel valve open. The check means act to retain a manual fuel valve operator in an orientation which holds the valve open and to automatically release the manual operator in response to the presence of either of two conditions in the vehicle fuel tank. Those conditions are a build-up of vapor pressure to a predetermined value and the rise of liquid in the fuel tank to a predetermined level. The improved check means comprise a release unit biased to a neutral position, but movable, in response to the two conditions, to first and second positions, which are in opposite directions from the neutral position; a movable member secured to the manual operator for releasably restraining movement thereof; and retainer means disposed intermediate the release unit and the movable member. In its neutral position the release unit forces the retainer means into engagement with the movable member to prevent the movement of that member and thus of the manual operator. In either of its first and second positions, the unit permits the retainer means to disengage from the movable member, thereby effectively releasing the manual operator and permitting the nozzle's fuel valve to close under the influence of its conventional biasing spring. In preferred embodiments, the release unit comprises a single flexible diaphragm secured to a hollow slide member having structure on its inner surface for forcing the retainer means against the movable member when the unit is in the neutral position.

Other objects, features, and advantages of the invention will appear from the following description of particular preferred embodiments which are illustrated in the accompanying drawings.

DETAILED DESCRIPTION OF PARTICULAR PREFERRED EMBODIMENTS

Figure 1:
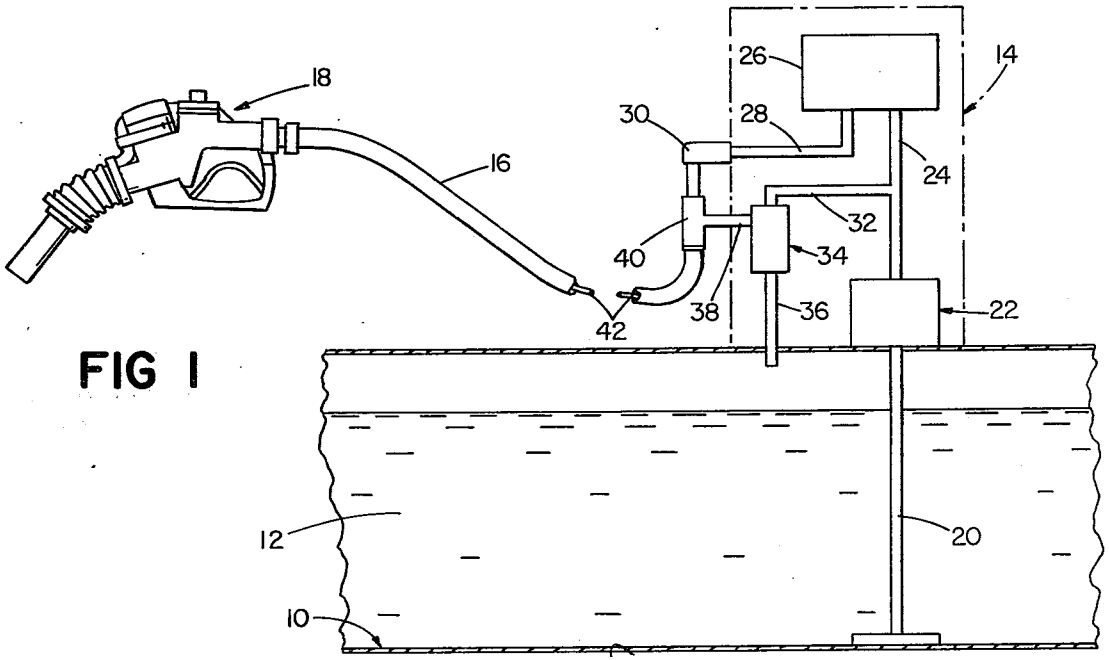
FIG. 1 is a schematic illustration of a fuel dispensing system incorporating features of the present invention.

FIG. 1 illustrates a generally conventional gasoline dispensing system comprising an underground reservoir 10 containing a supply of gasoline 12 and a dispensing station comprising a pump housing 14 and a flexible gasoline hose 16 extending between the housing 14 and a dispensing nozzle 18. A conduit 20 supplies gasoline 12 from reservoir 10 to a pump 22 disposed within housing 14. The pump output is delivered, via conduit 24, to a conventional meter or computer 26 for measuring the amount of gasoline dispensed. Another conduit 28 delivers gasoline from the meter 26 to a fitting 30 connected to flexible hose 16.

According to the present invention, a portion of the output of pump 22 is delivered by a conduit 32 to a liquid jet pump or aspirator device 34, the output of which is returned, by a conduit 36, to the reservoir 10. The suction developed by the jet pump 34 is conveyed, via a conduit 38 and a fitting 40, to a suction line in the form of a flexible vapor hose 42 disposed within the gasoline hose 16. The hose 42 is connected, as further described below, to receive vapors collected from a vehicle fuel tank being refueled by the nozzle 18. For use in a conventional one inch diameter gasoline hose 16, the hose 42 has a 5/16 inch inner diameter and 7/16 inch outer diameter. Hose 42 is formed from a material which will not be degraded by continuous immersion in gasoline over a wide range of temperature. Additionally, it must be sufficiently strong to withstand 20 to 30 psi external pressure, which is typically developed within the conventional hose 16, while conveying vapors internally at vacuum levels of approximately 12 to 16 inches of water. One suitable material which achieves all the above requirements for the hose 42 is polyurethane tubing having dimensions as stated above.

Vapor hose 42, with the characteristics described above, will transmit one and one-half standard cubic feet per minute a distance of 16 feet at a velocity of 2800 feet per minute with a pressure differential of approximately 12 to 16 inches of water. This volume of vapor is substantially equivalent to the volume of gasoline delivered to the vehicle fuel tank at a rate of about 11 gallons per minute. Thus, a suction line as described, along with a jet pump 34 capable of developing a vacuum of 12 to 16 inches of water, can handle the vapor displaced in the vehicle fuel tank by the liquid gasoline entering at rates up to 11 gallons per minute.

Conventional gasoline pumps 22 have a pressure setting of approximately 20 psi (gauge) and an internal liquid bypass system to accomodate variations in fueling rates from the extremes of no flow up to about 11 gallons per minute when the conventional fuel control valve within dispensing nozzle 18 is at a full open position. (Higher flow rates would require higher liquid pressure. Vacuum levels and vapor pumping capacity of a jet pump, however, automatically increase with pressure within the range of pressures ordinarily found in fuel dispensing systems.) The conduit sizes and fluid resistance in the liquid channel defined by conduits 32 and 36 and jet pump 34 are chosen such that approximately 2 to 3 gallons per minute of gasoline are consumed from the pump discharge. The jet pump is designed to generate the desired pressure differential of 12 to 16 inches of water using a liquid flow rate in the range of approximately 2 gallons per minute of liquid. While numerous specific jet pump designs would meet these operating requirements, one particular preferred embodiment is illustrated in FIG. 2.

Figure 2:
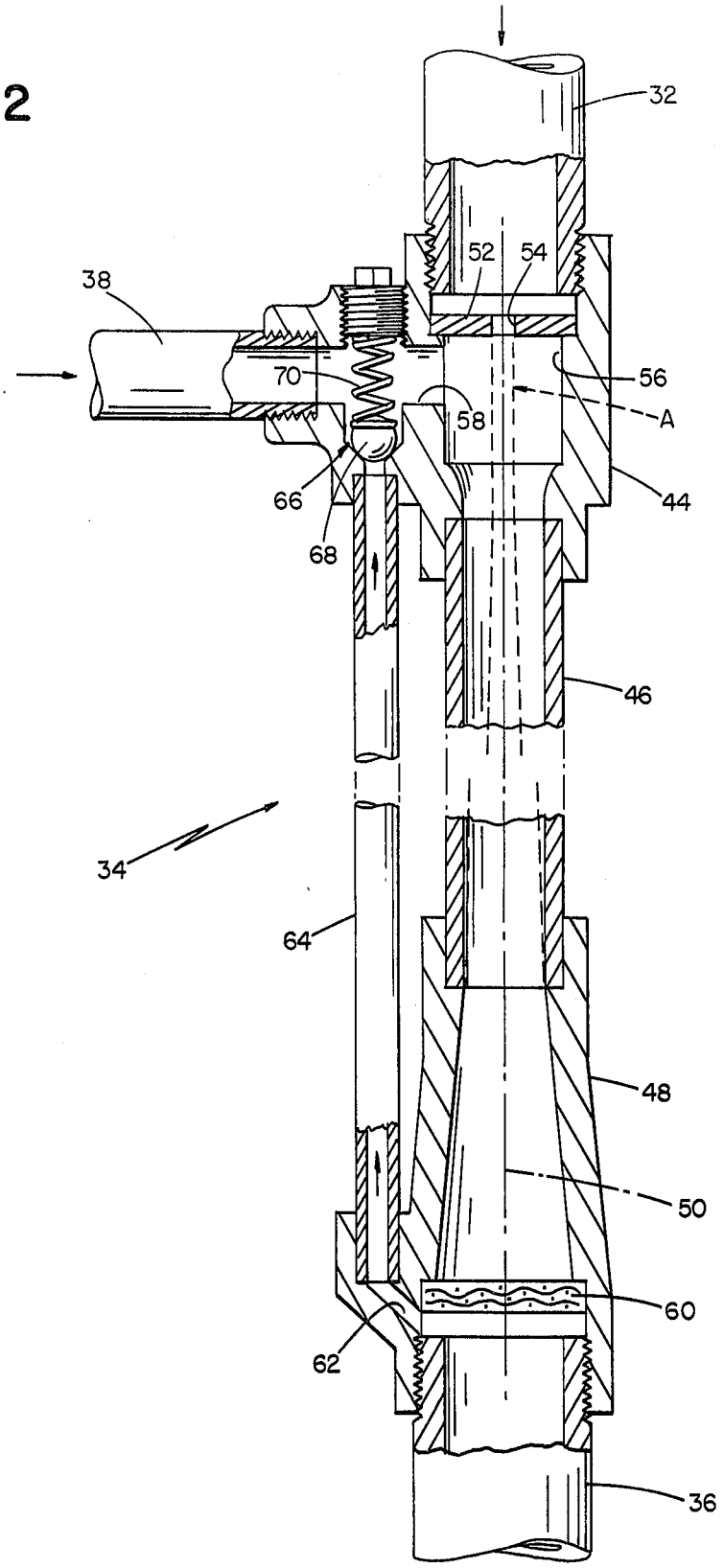
FIG. 2 is a sectional view of a liquid jet pump suitable for use in the system of FIG. 1.

Referring to FIG. 2, the jet pump 34 is mounted in a vertical orientation with the liquid gasoline entering from the top delivered by conduit 32 and exiting from the bottom into conduit 36. The jet pump includes an inlet section 44, a mixing tube 46, and a diffuser section 48. These elements have a common vertical axis 50. A plate 52, having a centrally located orifice 54, is mounted within the inlet section 44. A chamber 56, in inlet section 44 downstream of the plate 52, communicates via opening 58 with conduit 38. Conventional baffle screens 60 are provided at the downstream end of the diffuser section 48. An aperture 62 in the diffuser section 48, downstream of the baffle screen 60, communicates with a vacuum relief feedback line 64. The vacuum relief feedback line communicates through vacuum pressure relief valve 66 with an opening 58 of the inlet section 44, the valve 66 comprising a ball 68 seated against the upper end of line 64 and biased-closed by a spring 70.

In the operation of the jet pump 34, gasoline at 20 psi in the conduit 32 passes through the orifice 54 in plate 52 providing a gasoline jet indicated at A. As is well known, the jet pump operates to draw vapor from conduit 38, through opening 58, and into the chamber 56. The gasoline jet enters the mixing tube 46 and begins to break up as a solid liquid stream and to mix with the vapor which surrounds it, a process which is substantially completed in the mixing tube. The homogenous mixture of vapor bubbles entrapped in gasoline is then decelerated in the diffuser section. The vertical orientation of the jet pump takes advantage of any potential energy in the gasoline jet stream and also insures that the gasoline jet will remain centered in the mixing tube as the liquid breakup and vapor entrapment progress.

As is well known, the efficiency of a liquid jet pump is maximized when complete mixing of the liquid and the gas takes place at, or slightly before, the beginning of the diffuser section. Since the mixing tube is designed to optimally handle certain pressure levels and flow rates for both liquid and gas, it is important that these parameters remain nearly constant. While the liquid gasoline generally will be available at nearly constant pressure, the vapor from the vehicle fuel tank, supplied through conduit 38, will flow at a rate dependent upon the rate at which gasoline is being dispensed. The vacuum relief feedback line 64 and valve 66 help to stabilize vapor pressure and the flow rates. The valve spring 70 is chosen to bleed gasoline and vapor into the vacuum side of the jet pump from the feedback line 64 at a present level of vacuum in the chamber 56 (e.g., 16 inches of water). As long as the vapor flow in conduit 38 is lower than the design flow rate for vapor of the jet pump 34, the additional vapor required to maintain a constant vacuum in chamber 56 will be released from the feedback line by the relief valve 66. As will be discussed further below, the provision of feedback line 64 and relief valve 66 will, in certain circumstances, simplify the design of other features of the present invention relating to the dispensing nozzle 18.

Figure 3:
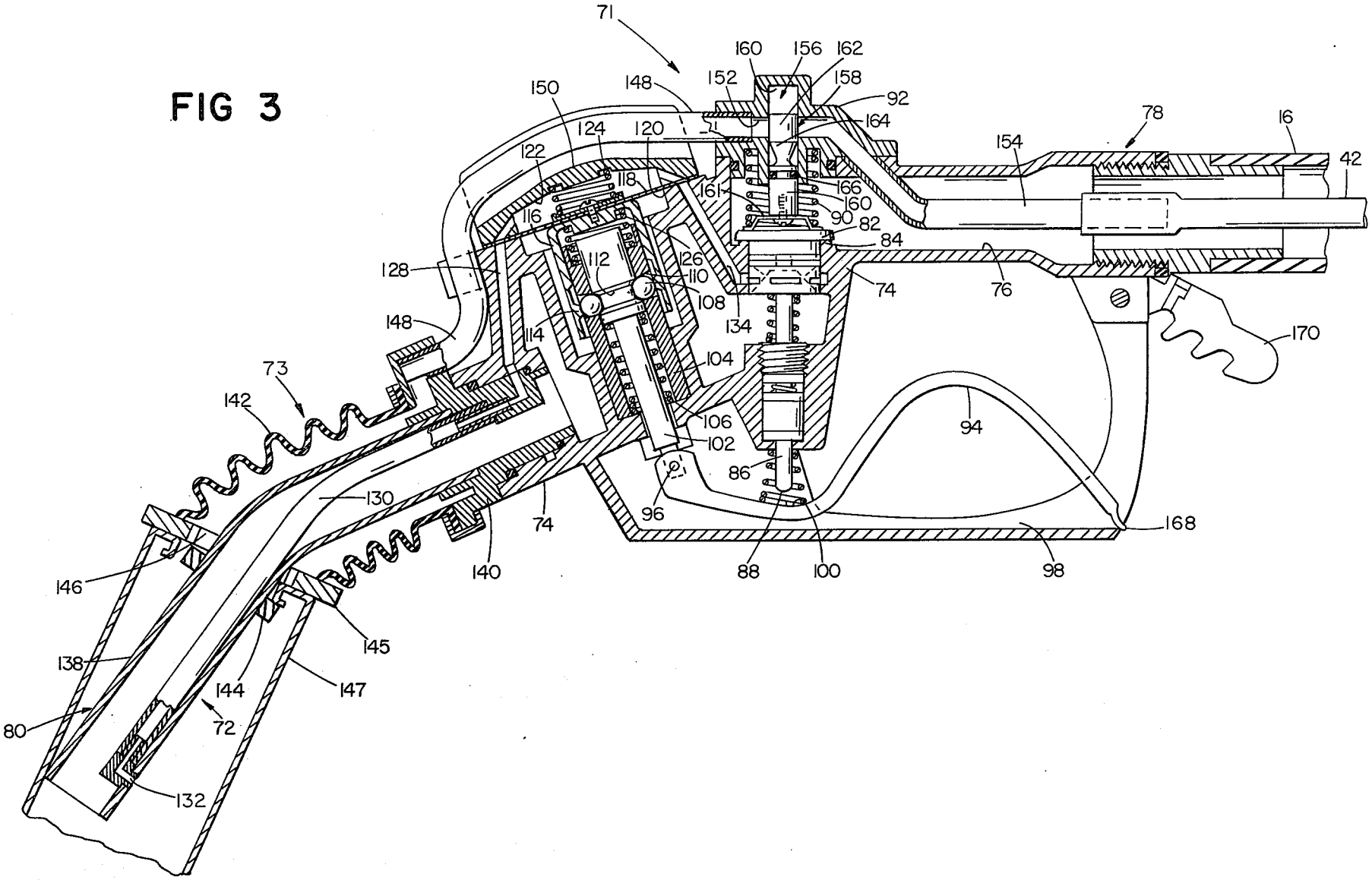
FIG. 3 is a sectional view of a fuel dispensing nozzle incorporating features of the present invention.

As illustrated in FIG. 3, the dispensing nozzle includes a body 71, a spout assembly 72, and a bellows unit 73. Body 71 comprises casting 74 having a gasoline conduit 76 extending from the pump, or inlet, side 78 of the nozzle to the spout, or outlet, side 80. A gasoline valve comprises a closure 82 which engages an annular seat 84 to shut off gasoline flow through conduit 76. A rigid shaft 86 having a rounded free end 88 extends from one side of the closure 82. Coil spring 90, biasing the closure member 82 to the closed position, bears against valve unit cap 92.

A manual fuel valve operator comprises lever arm 94 pivoted on a pin at a fulcrum point 96 for motion within an open-sided guard 98 and having a seat 100 for receiving the rounded end 88 of shaft 86. Fulcrum point 96 is integral with the lower end of a movable plunger 102 disposed for sliding motion in a cylindrical member 104 secured in body casting 74. The plunger 102 is urged to the rest position shown in FIG. 3 by a spring 106. A series of balls 108 are disposed in openings 110 in member 104 and engage in annular recess 112 of plunger 102, thus functioning as a retainer means which lock the plunger in the position shown in FIG. 3. The balls 108 are held in contact with the plunger by an annular rib 114 of the inner surface of a hollow cylindrical slide member 116 which surrounds the upper portion of member 104. The slide member is secured to an impervious flexible diaphragm 118, forming a unit which controls the retainer balls 108. The diaphragm is clamped in an internal recess of the body casting 74 and defines chambers 120, 122 on its opposite sides. Springs 124, 126 bias diaphragm 118 toward the rest position of FIG. 3. A first passageway 128 connects chamber 122 with conduit 130 having a mouth 132 at the outlet end 80 of spout 72, and a second passageway 134 connects it with the gasoline conduit 76 just below valve seat 84. The chamber 120 is open to the atmosphere through a small amount of air leakage around the plunger 102.

The spout assembly 72 includes a spout 138 and a fitting 140 which secures the spout to the body casting 74. The bellows unit 73 includes a flexible bellows 142 also secured to the fitting 140 and surrounding the upper portion of spout 138. A ring 144 is fixed to the spout. An end plate 145 of the bellows unit 73 includes a serrated opening 146 which communicates with the space between the bellows and the spout. End plate 145 acts as a seat against the fuel tank fill pipe 147 when the spout is inserted into the fill pipe. The nozzle is held in place by ring 144 when caught under the lip of the fill pipe mouth. The space between bellows 142 and spout 138 communicates with a conduit 148 which extends from the fitting 140 through an opening in a cap member 150 which partially defines the chamber 122 and against which the spring 124 bears. The conduit 148 communicates with a passageway 152 provided in valve unit cap 92. The passageway 152 leads to a rigid conduit 154 disposed within the larger gasoline conduit 76 and coupled to the internal flexible hose 42, described above in relation to FIG. 1. Preferably, conduit 148, passageway 152, and conduit 154 have the same inner diameter (i.e., 5/16 inch) as the flexible hose 42. The elements 148, 152, 154, and 42 form portions of the suction line through which hydrocarbon vapors are exhausted from a vehicle fuel tank. A vapor valve 156 for this suction line is provided in the valve unit cap 92. The vapor valve comprises a slide member 158 movable in a recess 160 transverse to the vapor passage 152. A lower portion 160 of the slide member 158 is secured to a spring pilot plate 161 which bears against the gasoline valve closure 82 for movement therewith. An upper portion 162 of the slide member is shaped to completely block the passageway 152 when the gasoline valve is in the closed position as indicated in FIG. 3. A middle portion 164 of the slide member 158 is of reduced cross-sectional area and is shaped to provide a progressively greater unblocked portion of the passageway 152 as the main gasoline valve is opened wider for greater rates of gasoline dispensing. A seal member 166 prevents leakage of gasoline from the conduit 76 to the passageway 152.

In the operation of the dispensing nozzle of FIG. 3, the manual operating lever 94 is pivoted about point 96 in the counter-clockwise direction (as viewed in FIG. 3) to apply an upward force to shaft 86 and thereby unseat the closure 82. As is well known, the free end 168 of lever 94 may be engaged with a conventional spring-loaded clip 170 to maintain the gasoline valve in an open configuration. With the lever 94 thus engaged with the clip 170, the flow of gasoline can be stopped manually by raising the lever to release its end 168 from the clip and then releasing the lever to allow the spring 90 to close the gasoline valve.

The conventional full-tank, automatic shutoff feature operates, as is well known in the art, when the gasoline in the vehicle's fuel tank covers the opening 132 of the conduit 130 at the end 80 of the spout assembly 72. Prior to the time when the gasoline reaches that level, the venturi effect immediately downstream of the gasoline valve seat 84, which causes a reduced pressure in chamber 122, is counterbalanced by the passage of air and/or gasoline vapor from the fuel tank through the conduit 130 and passageway 128 to the chamber 122. When the gasoline in the fuel tank covers the open end of conduit 130, however, the air/vapor mixture in chamber 122 is not replenished and the consequent pressure drop in that chamber causes the release unit (i.e., diaphragm 118 and attached slide member 116) to move upwardly. This movement causes the rib 114 of the slide member 116 no longer to be aligned with the retainer balls 108 and, therefore, permits those balls to move radially outwardly under the force of spring 90 transmitted through lever 94 and plunger 102. This movement of the plunger 102 causes the fulcrum point 96 to move downwardly and, as is well known, in conjunction with the shape and location of the clip 170, causes the lever 94 to disengage from the clip thereby allowing the gasoline valve to close.

A rise in the pressure of the air/vapor mixture in the vehicle fuel tank may indicate a failure of the vapor removal system and the imminent leakage of hydrocarbon vapors to the atmosphere. Such a pressure rise, however, will be transmitted to the chamber 122 via passageway 128 and conduit 130. The increased pressure in chamber 122 will cause a downward movement of the diaphragm 118 with the same result as described above. That is, the rib 114 of slide member 116 will no longer be aligned with the balls 108 and the consequent plunger movement and automatic reseating of the gasoline valve closure 82 will result. Thus, the single diaphragm arrangement described is effective to automatically prevent both the overflow of liquid gasoline from the vehicle fuel tank and either the escape of hydrocarbon vapors to the atmosphere or the rupture of the fuel tank if the vapor recovery system malfunctions.

Figure 5:
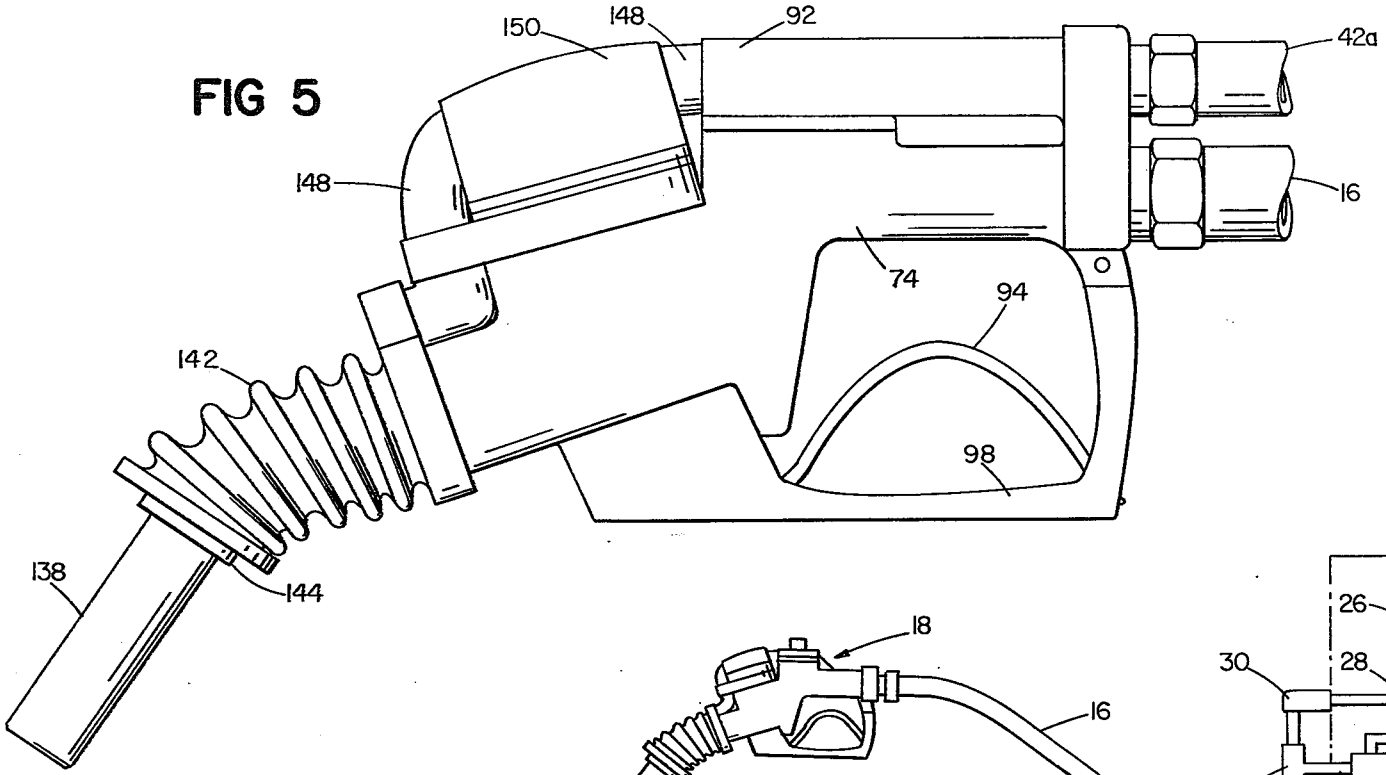
FIG. 5 is a side elevation of another alternative nozzle embodiment.

As will be evident to those skilled in the art, the vapor recovery and automatic shut-off features of the nozzle of FIG. 3 may be combined with supplementary vapor recovery systems other than that illustrated in FIG. 1. Thus, for example, the flexible hose 42 could be connected through locally actuated valves to a central vacuum pump rather than, as is presently preferred, to a jet pump 34 operating at each fuel dispensing station when the pump 22 at that station is actuated. Alternatively, the nozzle easily could be adapted for use in a "pressure balance" vapor recovery system, in which the vapor pressure within the fuel tank is employed to force vapors through a recovery line without assist from any vacuum apparatus. Such systems typically require a much larger vapor recovery hose, since the pressure differential which forces the vapor through that hose is much less than that of a vacuum assisted system. A nozzle adapted for such a system is illustrated in FIG. 5 wherein the larger vapor hose is indicated at 42*a*.

Figures 4, 6:
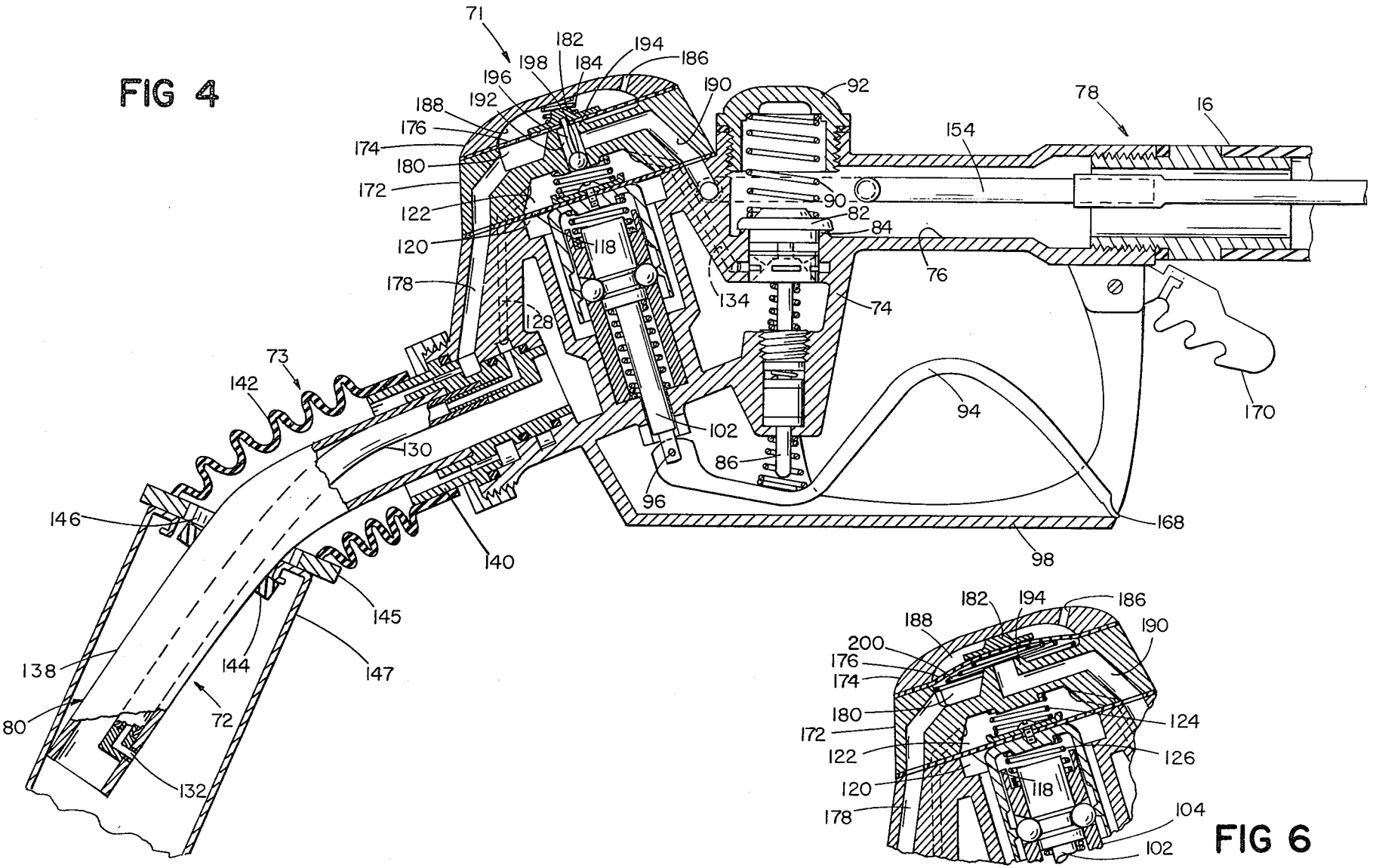
FIG. 4 is a view similar to FIG. 3 of an alternative nozzle embodiment.
FIG. 6 is a fragmentary sectional view of an alternative construction of the nozzle of FIG. 4.

The linking of the vapor valve to the gasoline valve in the dispensing nozzle, along with the provision of an appropriate profile for the vapor valve slide member, provides for a vapor suction line capacity sufficient to meet the anticipated vapor removal requirements produced by any given rate of delivery of liquid gasoline to a vehicle fuel tank. As is well known, however, owing to temperature differentials between the fuel being dispensed and the residual fuel and vapor already in the vehicle fuel tank, the volume of vapor which must be removed from the fuel tank may differ substantially from the volume of fuel delivered to the fuel tank. For example, a vapor growth of 30 percent or more may occur with certain temperature conditions. FIG. 4 illustrates an alternative dispensing nozzle embodiment in which a valve is provided in the vapor suction line which is not linked to the operation of the gasoline valve, but which operates automatically and responds to a slight positive vapor pressure in the vehicle fuel tank, thereby permitting the removal of vapors at the required rate independent of the rate of gasoline delivery to the fuel tank. Except for the described changes in the vapor suction line, the construction and operation of the nozzle is identical to that of FIG. 3.

As shown in FIG. 4, the cap 150 of FIG. 3 has been replaced by a pair of members 172, 174 with a diaphragm 176 clamped therebetween. The conduit 148 is replaced by a passageway 178 within both the body casting 74 and member 172, the passageway 178 communicating with a chamber 180 beneath the diaphragm 176. A force-distributing fitting 182 is centrally located on, and secured to, the upper surface of the diaphragm 176. A spring 184 exerts a very light force to retain the diaphragm, in the absence of external forces, in the position indicated in FIG. 4. An opening 186 in the member 174 vents the space 188 above diaphragm 176 to the atmosphere.

Downstream of the diaphragm 176, the suction line continues in the form of another passageway 190 provided in body casting 74 and in member 172. The passageway 190 communicates with a conduit (not shown) which is external of the body casting 74 and which connects the passageway 190 with the conduit 154. At its other end, the passageway 190 merges beneath the diaphragm 176 with a passageway 192 which is coaxial with the diaphragm 176. The passageway 192 extends in both directions from the intersection with passageway 190, communicating at its lower end with the chamber 122 above diaphragm 118 and terminating at its upper end at a ring-shaped, sealing edge 194 which engages the diaphragm 176 opposite the member 182. A ball 198 is disposed in the lower branch of passage 192 and is connected to diaphragm 176, and fitting 182, through a semi-rigid, flexible column 196, such as a small diameter braided cable. The ball 198 is preferably a precision ball bearing having a close fit relationship with the circular cross-section passageway 192.

With the arrangement just described, the ball 198 and the portion of the diaphragm 176 exposed to the passageway 192 present substantially equivalent areas to the vacuum source which communicates with passageway 190, thus cancelling the effect of the vacuum upon the diaphragm. Since the ball bearing 198 does not represent an absolute seal against vapor flow, a small quantity of vapor will be drawn from the chamber 122. This chamber, however, is ultimately connected with the vapor in the vehicle fuel tank. Under normal operating conditions a slight vacuum prevails in chamber 122, and for this reason there will be a slight imbalance of forces in the system comprising the diaphragm 176 and ball bearing 198. This imbalance is not significant in terms of the operation of the valve formed by the diaphragm 176 and passageway 192 and does insure that all vapor, and no excess air, will be admitted to the vacuum system.

In operation, as the gasoline valve in the nozzle is opened to dispense fuel, the pressure of the vapor within the vehicle's fuel tank will increase, since those vapors are retained by the end plate 145 of the bellows unit 142 which abuts the mouth of the fuel tank fill pipe 147. The vapor pressure within the vehicle tank will be transmitted to th chamber 180 beneath the flexible diaphragm 176. With appropriate choices of flexibility of diaphragm 176 and force of spring 184, the vapor pressure level in chamber 180 which will cause the diaphragm to rise, thereby opening the vapor valve, may be chosen at will. For example, these parameters can be adjusted such that a very slight positive pressure level of, say, 0.2 inches of water in the chamber 180 will cause the diaphragm to move away from the seat 194, thereby exposing the vapor in the fuel tank to the suction provided through passageway 190. As long as the vapor pressure within the chamber 180 (and therefore within the fuel tank of the vehicle) remains at or above the predetermined pressure level, the diaphragm valve will remain open and the vacuum system will continue to evacuate vapors from the vehicle fuel tank. This arrangement is not sensitive to vacuum levels nor to the rate of delivery of gasoline to the fuel tank, but operates automatically whenever the vapor pressure within the fuel tank rises.

The provision of the second flexible diaphragm 176 in the embodiment of FIG. 4, of course, does not change the operation of the single-diaphragm (i.e., diaphragm 118), dual-mode automatic shutoff arrangement described above in relation to FIG. 3. Additionally, the features of the nozzle of FIG. 4, just as those of the nozzle of FIG. 3, may be employed with other forms of supplementary vapor recovery systems than that illustrated in FIG. 1 and the other features of the two nozzles may be combined with each other, if desired, i.e., the slide member 158 arrangement of FIG. 3 may be employed in the combination of FIG. 4 for optimum results.

An additional difference between the valving arrangements of FIGS. 3 and 4 concerns impact upon the jet pump design (see FIG. 2). Thus, the shaping of the slide member 158 of FIG. 3 is rendered less critical by the jet pump feedback arrangement, since jet pump efficiency and suction level variations are eliminated as factors influencing the slide member profile. Since the valve of FIG. 4 has no equivalent "profile" problem, the feedback feature of the jet pump becomes somewhat less important and could more easily be omitted to reduce overall expense.

An alternative vapor control valve arrangement is illustrated in FIG. 6. Here the diaphragm 176 is biased to an open configuration by a spiral spring 200. With this arrangement the valve would close whenever the vacuum level in chamber 180, and thus in the vehicle fuel tank, exceeds a predetermined value (e.g., 0.2 inch of water). The fuel tank is, therefore, protected from potentially damaging large internal pressure reductions. The vapor conduit is sealed, when the spout is withdrawn from the fill pipe, since the ring 144 will block the serrated openings 146 of end plate 145.

The predominant factors affecting choice between the diaphragm biasing arrangements of FIGS. 4 and 6 are the implications of maintaining, respectively, a slight positive or a slight negative pressure in the vehicle fuel tank. A positive pressure will preclude the capture of excess ambient air, but will, no doubt, lead to a slight vapor loss at the fill pipe-nozzle interface. Negative pressure will assist in the full recovery of vapors, but will probably draw air into the vapor recovery line at the fill pipe-nozzle interface.

Any of the nozzle arrangements can be provided with a safety valve for venting the vapor conduit to the ambient atmosphere in order to prevent excessive pressure in a vehicle fuel tank if the nozzle's shutoff feature should fail.

While particular preferred embodiments have been illustrated in the drawings and described in detail herein, other embodiments are within the scope of the invention and the following claims.

1. In a liquid dispensing nozzle comprising a body having an inlet and an outlet and defining a liquid conduit therebetween, said outlet defining a spout insertable into a container, a valve in said conduit controlling the flow of liquid from said inlet to said outlet, said valve biased toward a closed configuration, a manual valve operator for opening said valve, and means for releasably retaining said valve operator in an orientation which holds said valve open and for automatically releasing said valve operator in response to either of two conditions in said container, said conditions being buildup of vapor pressure to a predetermined vapor pressure and liquid reaching a predetermined level, the improvement wherein said means comprise a release unit biased to a neutral position in the absence of either of said conditions in said container, and movable, in response to said conditions, to first and second positions which are in opposite directions from said neutral position, a movable member secured to said valve operator, and retainer means disposed intermediate said release unit and said movable member, said release unit in said neutral position forcing said retainer means into engagement with said movable member to prevent movement thereof, but in said first and second positions releasing said retainer means.

2. The improvement of claim 1 wherein said release unit comprises a single flexible diaphragm, said nozzle further including a chamber on one side of said diaphragm, said chamber communicating with said tank.

3. The improvement of claim 2 wherein said release unit further comprises a hollow slide member secured to said diaphragm, and including structure on its inner surface for engaging said retainer means when said release unit is in said neutral position.

* * * * *

UNITED STATES PATENT AND TRADEMARK OFFICE

CERTIFICATE OF CORRECTION

PATENT NO. : 4,057,086

DATED : November 8, 1977

INVENTOR(S) : James W. Healy

It is certified that error appears in the above-identified patent and that said Letters Patent are hereby corrected as shown below:

Column 1, lines 64-67, after "reservoir", insert a period and delete "means associated with the nozzle are provided for regulating the pressure in the space between the nozzle and the fill pipe when the nozzle is inserted therein.";

Column 8, line 34, before "chamber", "the" is misspelled;

Column 8, lines 62-66, after "Fig. 1", insert a period and delete "and the other features of the two nozzles may be combined with each other, if desired, i.e., the slide member 158 arrangement of Fig. 3 may be employed in the combination of Fig. 4 for optimum results.".

Signed and Sealed this

***Twenty-third* Day of *May 1978***

[SEAL]

*Attest:*

RUTH C. MASON
*Attesting Officer*

LUTRELLE F. PARKER
*Acting Commissioner of Patents and Trademarks*